United States Patent [19]

Tippins et al.

[11] 4,455,848

[45] Jun. 26, 1984

[54] APPARATUS FOR UNDERWINDING STRIP ON A DRUM IN A HOT REVERSING MILL

[75] Inventors: George W. Tippins; John E. Thomas; Richard S. Connolly, all of Pittsburgh; Charles K. Pine, Gibsonia; Wayne G. Pottmeyer, Murrysville, all of Pa.

[73] Assignee: Tippins Machinery Company, Inc., Pittsburgh, Pa.

[21] Appl. No.: 417,423

[22] Filed: Sep. 13, 1982

[51] Int. Cl.[3] ..... B21B 37/00; B21B 41/06; B21B 1/34

[52] U.S. Cl. ..... 72/12; 72/14; 72/148; 72/205; 72/229

[58] Field of Search ..... 72/10, 12, 14, 15, 21, 72/31, 148, 200, 202, 205, 229, 365; 242/78.1, 78.3

[56] References Cited

U.S. PATENT DOCUMENTS

| | | | |
|---|---|---|---|
| 1,882,219 | 10/1932 | Harwood et al. | 72/148 X |
| 2,628,790 | 2/1953 | Schmidt et al. | 72/148 X |
| 2,646,231 | 7/1953 | Frielinghaus | 72/148 |
| 2,658,741 | 11/1953 | Schmidt et al. | 72/148 X |
| 2,675,720 | 4/1954 | Ferm | 72/148 |
| 3,028,114 | 4/1962 | Asbeck | 72/148 X |
| 3,331,232 | 7/1967 | King | 72/229 X |
| 3,422,649 | 1/1969 | Lowy | 72/31 X |
| 4,263,798 | 4/1981 | Wladika et al. | 72/202 |

FOREIGN PATENT DOCUMENTS 811837 8/1951 Fed. Rep. of Germany .

*Primary Examiner*—E. Michael Combs

*Attorney, Agent, or Firm*—Webb, Burden, Robinson & Webb

[57] ABSTRACT

A method of underwinding strip on a drum along the passline of a hot reversing mill comprises positioning the drum in a receiving mode, passing the strip through the mill at a given thread speed, detecting the presence of the strip at a given position in relation to the drum, activating the drum in an underwinding direction at a given time delay representative of a distance in which the strip is through the drum slot and internal of the drum, and speed matching the drum and the strip in an initial surface winding mode and a subsequent center driven tension mode. The apparatus includes a pair of drums, each positioned on an opposite side of the hot reversing mill, a pair of gates, each positioned along the table rolls to deflect the strip into the drum slots, a tilt table roll assembly on each side of the mill adapted to pivot into engagement with the drum downstream of the slot to retain the strip against a portion of the drum, a detector positioned between the drum and the mill to detect the presence of the strip, an activator for causing each drum to rotate in an underwinding direction when the strip enters the slot, and to speed match each drum to the strip, and a converting member for converting each drum from a surface winding mode to a center driven tension mode after a given number of wraps.

4 Claims, 4 Drawing Figures

APPARATUS FOR UNDERWINDING STRIP ON A DRUM IN A HOT REVERSING MILL

FIELD OF THE INVENTION

Our invention relates to strip coilers, and more particularly to the underwinding of the coiler drums located on opposite sides of a hot reversing mill.

DESCRIPTION OF THE PRIOR ART

Hot reversing mills for plate and strip having coiler furnaces on opposing sides thereof are employed in semi-continuous mills and as mini-mills for processing metal slabs such as steel into a hot rolled product. The coilers have conventionally been of the overwinding type in which the leading end of the strip is engaged in a slot in the drum and the drum is caused to rotate in an overwinding direction. Such a system is adequate for thin gauge strip and steels and steel alloys of relatively low brittleness.

As the drum containing the strip in its slot is activated in an overwinding direction, a kink in the strip is formed as the strip is caused to bend about the trailing edge of the slot. Continued winding about the drum places high stress on the drum, particularly in the area of the trailing edge of the slot, where the kink is formed. In addition, a certain interruption in rolling takes place as the direction of the forward moving strip is changed to an overwinding direction about the drum when the drum is positioned above the passline.

It is also known to operate the drum in a center driven tension mode to assist in the reduction of the strip at the roll nip of the hot reversing mill.

SUMMARY OF THE INVENTION

It is an object of our invention to increase the life of the drum by eliminating the high stresses and the load on the drum.

It is a further object of our invention to allow for the coiling of more brittle and/or heavier material than normally processed heretofore.

It is still further an object to provide an improved continuity in the rolling process by eliminating the reverse bending and resultant kink typical in overwinding coilers.

Our invention provides for method and apparatus for the underwinding of strip on a drum along the passline of a hot reversing mill. The method includes positioning the drum in a receiving mode, passing the strip through the mill at a given thread speed, detecting the presence of the strip at a given position upstream of the drum, activating the drum in an underwinding direction at a given time delay representative of a given distance in which the strip is through the drum slot and internal of the drum, and speed matching the drum and strip as the strip is surface-wound about the drum in a surface winding mode. After a given number of wraps about the drum, the operation of the drum is converted from a surface winding mode to a center winding tension mode.

Each of the drums is equipped with an entry slot and enlarged shoulder inward of and adjacent the slot. A gate is positioned along the table rolls of the mill and adjacent each drum to rotate upward to deflect the strip into the slot. A tilt table roll assembly is positioned adjacent each drum to pivot into engagement with the drum downstream of the slot to retain the strip against a portion of the drum. Detection means, such as an air switch, is positioned between each drum and the mill to detect the presence of the strip. Activation means are provided for causing the drum to rotate in an underwinding direction when the strip enters the slot and to speed match each drum to the strip. Converting means are provided for converting each drum from a surface winding mode to a center driven tension mode after a given number of wraps. The tilt table roll assembly includes at least two table rolls movable from a first position along the passline to a second position in engagement with the drum. The activation means includes a pulse counter attached to the mill motor which measures pulses which are representative of distance traveled by the strip for a given rolling speed.

DESCRIPTION OF THE PREFERRED EMBODIMENTS

Figure 1:
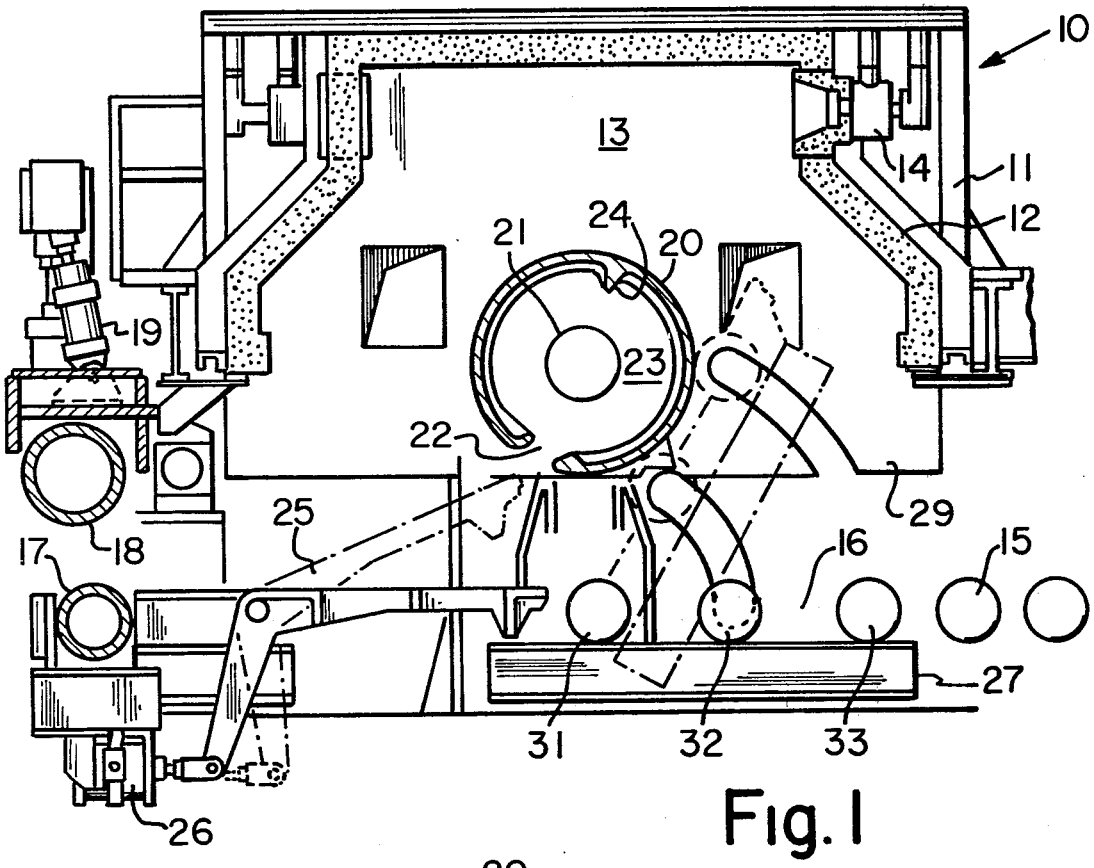
FIG. 1 is a section through a coiler furnace including a drum adapted for underwinding.

A coiler furnace, generally designated 10, of the type employed with hot reversing mills is illustrated in FIG. 1. The coiler furnace 10 includes a furnace structure 11 and a furnace lining 12 defining the furnace chamber 13. Burners 14 extend through the lining 12 so as to fire into the chamber 13 although in some coiler furnaces sufficient heat is retained within the coils so as to eliminate the need for an external heat source.

The coiler furnace 10 is normally positioned above the strip passline 16, which is defined by a plurality of table rolls 15 forming the support for the strip of steel or other metal. In order to hold the tail end of the strip after coiling and for feeding back into the roll nip, a set of pinch rolls formed of a stationary bottom roll 17 and a movable top roll 18 controlled by a hydraulic cylinder 19 are located adjacent the entry of the furnace 10 along the passline 16.

In the embodiment illustrated, a drum 20 is centrally positioned in the furnace chamber 13 above the passline 16. A deflector gate 25 operated through a hydraulic cylinder 26 is positioned beneath the passline 16 and is adapted to pivot upward to deflect the strip into the slot 22 of the drum 20.

Figure 3:
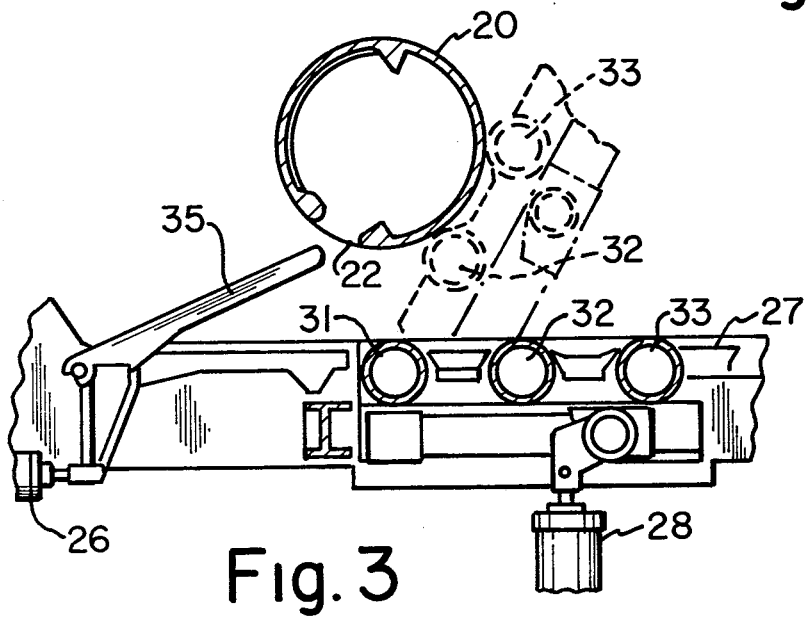
FIG. 3 is a view partly in section showing a single drum with the deflector gate and tiltable table assembly.

A section of the table rolls substantially subjacent the drum, namely table rolls 31, 32 and 33 form a tiltable table assembly 27, FIGS. 1 and 3. Tiltable table assembly 27 is activated by hydraulic cylinder 28 so as to cause pivoting of the assembly 27 about roll 31 and within slotted frame 29 of the furnace structure so as to cause rolls 32 and 33 to be positioned adjacent the exterior of drum 20 slightly downstream of the drum slot 22.

Figure 4:
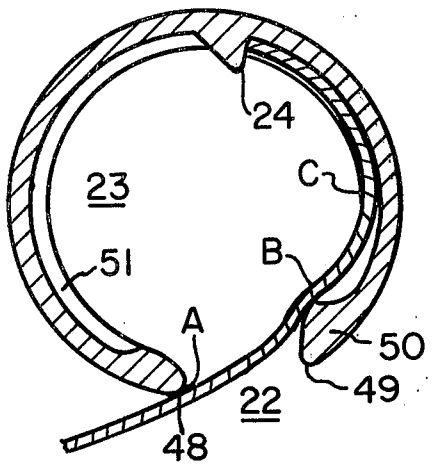
FIG. 4 is a section through a drum used in the initial stage of accepting strip.

The details of the drum 20 are best seen in FIG. 4. Drum 20 is cylindrical and includes a plurality of internal ribs 51 for stiffening purposes as is commonly known in the art. The slot 22 which accepts the lead end of the strip 39 is defined by a leading slot edge 48 and a trailing slot edge 49. Just rearward of trailing slot edge 49 and within the drum interior 23 is an enlarged shoulder 50. In addition, a strip stop 24 extends radially inward into the drum interior 23 at a position substantially diametrically opposite the drum slot 22. The leading slot edge 48, the shoulder 50 and the interior of the drum between the shoulder 50 and the stop 24 define a tortuous path for the strip so as to provide frictional retaining engagement within the drum as surface winding about the drum exterior is initiated.

The tortuous path is formed of at least a three point contact shown as A, B and C located at the leading edge 48, the shoulder 50 and along the drum interior respectively. Theoretically the stop 24 is not needed but it provides a safety factor to increase the frictional contact as acceleration of the drum takes place.

Figure 2:
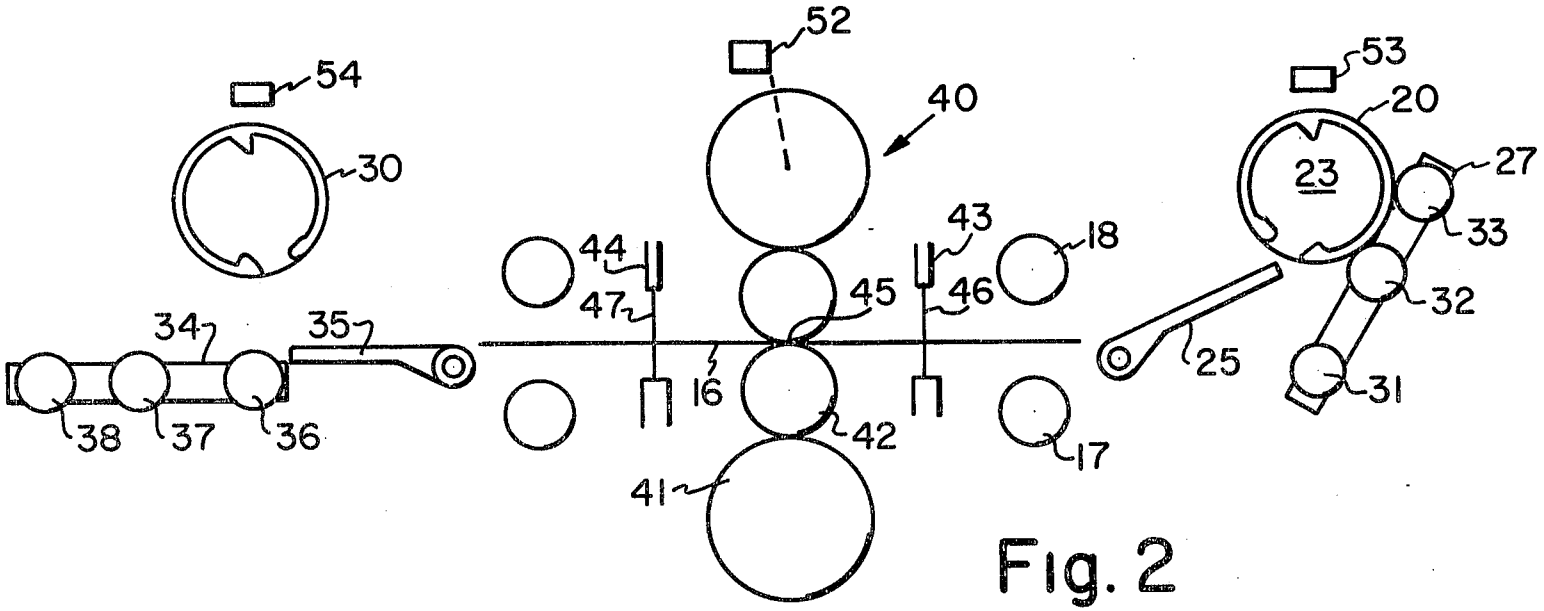
FIG. 2 is a schematic of a hot reversing mill employing our invention.

In application, a coiler furnace and drum 20 and a coiler furnace and drum 30 are positioned on opposite sides of the hot reversing mill 40, FIG. 2. The hot reversing mill 40 includes a pair of work rolls 42 which define a roll nip 45 therebetween and a pair of back-up rolls 41 to support the work rolls 42.

The various rolls are supported in a mill housing (not shown). Associated with drum 20 is deflector gate 25 and tilt table assembly 27 comprised of rolls 31, 32 and 33. Associated with drum 30 on the opposite side of the hot reversing mill 40 is deflector gate 35 and tilt table assembly 34 consisting of table rolls 36, 37 and 38.

Positioned between the hot reversing mill 40 and the set of pinch rolls 17 and 18 adjacent the coiler furnace 10 is air switch 43 which defines an air curtain 46 extending vertically through the passline 16, FIGS. 1 and 2. In a similar manner air switch 44 having an air curtain 47 extending vertically though the passline 16 is positioned between the hot reversing mill 40 and the furnace containing the other coiler drum 30. A pulse counter 52 is associated with the mill motor driving the hot reversing mill 40 and wrap counters 53 and 54 are associated with the drums 20 and 30 respectively, as will be explained in more detail hereinafter.

The hot reversing mill 40 of FIG. 2 operates as follows. The air switches 43 and 44 continually provide the air curtains 46 and 47 respectively, on opposite sides of the mill. Each air switch extends through the passline 16. When the strip interrupts the air curtain 47 and air curtain 46 is not interrupted by metal, drum 20 goes into its spotting or receiving position with the slot 22 positioned to receive the strip end. In that spotting position the deflector gate 25 is raised to direct the strip into the slot and at the same time tilt table 27 is raised so that rolls 32 and 33 are in engagement with the exterior of drum 20.

Conversely, when air switch 43 senses metal and air switch 44 does not, drum 30 assumes its spotting position and deflector 35 and tilt table 38 assume their go positions.

The operator who has set the mill initiates the decoiling of the strip off the loaded coiler 30, through the pinch rolls adajacent the furnace, along the table rolls and through the air curtain 47 at a given thread speed such as 250 feet per minute into the mill 40. The strip exits the roll nip 45, passes through the air curtain 46, the pinch rolls 17 and 18 in the open position and then travels up the deflector gate 25 into the slot 22 of the drum 20 and into the drum interior 23. The drum 20 is automatically activated when the strip has traveled a given distance from a fixed point such as the air curtain 46 placing it internal of the slot 22 and drum 20. This distance is measured by pulse counter 52 which is connected to the motor drive on the rolls of the mill 40. In other words, the work roll has a known circumference and a single revolution represents a calculatable linear distance. The number of pulses per revolution of the work roll is also known so each pulse represents a linear distance. A position regulator monitors these pulses when the strip passes the air switch so that linear distance from the air switch is known to initiate activation of the drum when the strip is within the drum slot and internal of the drum.

Ultimately, the drum must be speed matched with the strip. In other words, the peripheral speed of the drum should at least equal the speed of the strip. To arrive at this position, the drum is accelerated rapidly at a speed greater than the strip and then at a given position is cut back to the speed match with the strip. During the initial wraps about the drum 20 and while the drum 20 is being speed matched to the strip, the strip is locked to the drum by means of the tilt table rolls 32 and 33. During the initial wraps, the strip is in a surface winding position with respect to drum 20.

Since it is desirable to oprate the mill 40 with the strip in tension from the coilers (drum speed slightly greater than strip) the coilers are converted into a center drive tension mode after a given number of wraps about the drum. For this purpose a wrap counter 53 is associated with drum 20 and a wrap counter 54 is associated with drum 30. During the initial laps, e.g. the first two and a half laps, the drum is in a surface winding situation. When the wrap counter detects the preset number of laps an appropriate switch is triggered so as to convert from the surface winding situation to the standard center driven tension mode of operation.

As previously stated, the strip is initially held within the drum interior through a three point contact consisting of the leading slot edge 48, the enlarged shoulder 50 and surface contact within the interior of the drum somewhere between the shoulder 50 and stop 24. At the momement the drum accelerates, the gate drops and the pinch rolls continue to maintain contact with the drum exterior. At the time the drum is converted from surface winding to center winding, the tilt table rolls then return along the passline.

The strip continues to wrap about the drum until the tail end of the strip passes the air switch at which time the pinch roll closes to trap the strip end and prevent it from wrapping about the drum. At the appropriate time the pinch rolls are then reversed to feed the strip back into the roll nip. As the strip passes the air switch the drum, deflector gate and tilt table on the opposite side of the mill assume their spotting or receiving positions.

We claim:

1. In a hot reversing mill having coiler drums on opposite sides thereof along a passline defined by a series of table rolls, the improvement comprising means for underwinding the coiler drum including:

A. each of said drums having an entry slot and an enlarged shoulder inward of and adjacent said slot;

B. a pair of gates, each positioned along said table rolls and adjacent to said drum rotating upward to deflect a strip into said slot;

C. a tilt table roll assembly on each side of said mill adapted to pivot into engagement with a drum donwstream of said slot to retain said strip against a portion of said drum;

D. detection means positioned between each drum and said mill along said passline to detect the presence of said strip;

E. activation means responsive to said detection means for causing each drum to rotate in an underwinding direction when said strip enters said slot and to speed match each drum to said strip; and F. converting means for converting each drum from a surface winding mode to a center driven tension mode after a given number of wraps of said strip around said drums.

2. The improvement of claim 1, said detection means comprising an air switch sending an air stream through said passline with said strip interrupting the flow.

3. The improvement of claim 2, said activation means including a pulse counter attached to a mill motor, said counter measuring pulses which represent distance traveled by said strip passing through the rolls of said mill thereby activating said drum at a predetermined distance travelled.

4. The improvement of claim 1, said tilt table roll assembly including at least two table rolls movable from a first position along said passline to a second position in engagement with said drum.

* * * * *

UNITED STATES PATENT AND TRADEMARK OFFICE

CERTIFICATE OF CORRECTION

PATENT NO. : 4,455,848

DATED : June 26, 1984

INVENTOR(S) : George W. Tippins et al.

It is certified that error appears in the above-identified patent and that said Letters Patent is hereby corrected as shown below:

Column 3 Line 56 "adajacent" should read --adjacent--.

Column 4 Line 20 "oprate" should read --operate--.

Column 4 Line 37 "momement" should read --moment--.

Claim 1 - Column 4 Line 62 "donwstream" should read --downstream--.

Claim 3 - Column 6 Line 4 "the" should read --said--.

Signed and Sealed this

*Eleventh* Day of *December 1984*

[SEAL]

*Attest:*

GERALD J. MOSSINGHOFF

*Attesting Officer* *Commissioner of Patents and Trademarks*